US008485264B2

(12) United States Patent
Hutin et al.

(10) Patent No.: US 8,485,264 B2
(45) Date of Patent: Jul. 16, 2013

(54) MULTI-STAGE MODULATOR

(75) Inventors: Remi Hutin, Bures sur Yvette (FR); Shyam B. Mehta, Missouri City, TX (US); Amandine Battentier, Fontenay Aux Roses (FR); Han Yu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 337 days.

(21) Appl. No.: 12/403,184

(22) Filed: Mar. 12, 2009

(65) Prior Publication Data

US 2010/0230113 A1 Sep. 16, 2010

(51) Int. Cl.
*E21B 34/06* (2006.01)
*E21B 47/18* (2006.01)

(52) U.S. Cl.
USPC ..... 166/373; 367/84

(58) Field of Classification Search
USPC ..... 166/373, 250.01, 65, 66; 175/40, 175/232, 48; 418/1, 5; 367/83, 84; 340/853.1, 340/453.3, 453.4, 853.3, 855.4
See application file for complete search history.

(56) References Cited

U.S. PATENT DOCUMENTS 3,309,656 A 3/1967 Godbey
4,785,300 A * 11/1988 Chin et al. ..... 367/83
4,847,815 A * 7/1989 Malone ..... 367/84
5,583,827 A * 12/1996 Chin ..... 367/84
5,586,083 A * 12/1996 Chin et al. ..... 367/84
5,636,178 A * 6/1997 Ritter ..... 367/83
5,740,126 A 4/1998 Chin et al.
5,787,052 A * 7/1998 Gardner et al. ..... 367/84
5,831,177 A * 11/1998 Waid et al. ..... 73/861.77
6,626,253 B2 9/2003 Hahn et al.
6,975,244 B2 12/2005 Hahn et al.
7,230,880 B2 * 6/2007 Lehr ..... 367/84
2005/0117453 A1 6/2005 Lehr
2007/0132606 A1 * 6/2007 Reckmann et al. ..... 340/855.4
2007/0201308 A1 * 8/2007 Wassermann et al. ..... 367/82
2011/0073374 A1 * 3/2011 Bunney et al. ..... 175/107

FOREIGN PATENT DOCUMENTS

GB 2415977 1/2006

OTHER PUBLICATIONS

Search Report for the equivalent European patent application No. 10156119.9 issued on Jan. 4, 2013.

* cited by examiner

*Primary Examiner* — Jennifer H Gay
*Assistant Examiner* — Michael Wills, III
(74) *Attorney, Agent, or Firm* — Chadwick A. Sullivan

(57) ABSTRACT

Methods and systems for pulse generation assembly that includes a plurality of staged valves operably coupled serially in a bottomhole assembly of a wellbore tool. The plurality of staged valves are operated in a substantially synchronized manner, thereby generating a series of pressure pulses. The signal strength of the generated pulse signal is multiplied by the number of staged valves in the series, and the pulse generation assembly of the disclosure is less susceptible to jamming, shock, and erosion. Further, by sequentially stopping at least one stage of the assembly and then synchronously rotating other stages, amplitude modulation is accomplished.

27 Claims, 4 Drawing Sheets

MULTI-STAGE MODULATOR

TECHNICAL FIELD

This invention relates to wellbore communication systems and particularly to systems and methods for generating and transmitting data signals to the surface of the earth while drilling a borehole, wherein the transmitted signal is generated by a multi-stage stacked modulator.

BACKGROUND

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials and the materials can be recovered.

At the bottom end of the drill string is a "bottom hole assembly" ("BHA"). The BHA includes the drill bit along with sensors, control mechanisms, and the required circuitry. A typical BHA includes sensors that measure various properties of the formation and of the fluid that is contained in the formation. A BHA may also include sensors that measure the BHA's orientation and position.

The drilling operations may be controlled by an operator at the surface or operators at a remote operations support center. The drill string is rotated at a desired rate by a rotary table, or top drive, at the surface, and the operator controls the weight-on-bit and other operating parameters of the drilling process.

Another aspect of drilling and well control relates to the drilling fluid, called "mud". The mud is a fluid that is pumped from the surface to the drill bit by way of the drill string. The mud serves to cool and lubricate the drill bit, and it carries the drill cuttings back to the surface. The density of the mud is carefully controlled to maintain the hydrostatic pressure in the borehole at desired levels.

In order for the operator to be aware of the measurements made by the sensors in the BHA, and for the operator to be able to control the direction of the drill bit, communication between the operator at the surface and the BHA are necessary. A "downlink" is a communication from the surface to the BHA. Based on the data collected by the sensors in the BHA, an operator may desire to send a command to the BHA. A common command is an instruction for the BHA to change the direction of drilling.

Likewise, an "uplink" is a communication from the BHA to the surface. An uplink is typically a transmission of the data collected by the sensors in the BHA. For example, it is often important for an operator to know the BHA orientation. Thus, the orientation data collected by sensors in the BHA is often transmitted to the surface. Uplink communications are also used to confirm that a downlink command was correctly understood.

One common method of communication is called "mud pulse telemetry." Mud pulse telemetry is a method of sending signals, either downlinks or uplinks, by creating pressure and/or flow rate pulses in the mud. These pulses may be detected by sensors at the receiving location. For example, in a downlink operation, a change in the pressure or the flow rate of the mud being pumped down the drill string may be detected by a sensor in the BHA. The pattern of the pulses, such as the frequency, the phase, and the amplitude, may be detected by the sensors and interpreted so that the command may be understood by the BHA.

Mud pulse systems are typically classified as one of two species depending upon the type of pressure pulse generator used, although "hybrid" systems have been disclosed. The first species uses a valving "poppet" system to generate a series of either positive or negative, and essentially discrete, pressure pulses which are digital representations of transmitted data. The second species, an example of which is disclosed in U.S. Pat. No. 3,309,656, comprises a rotary valve or "mud siren" pressure pulse generator which repeatedly interrupts the flow of the drilling fluid, and thus causes varying pressure waves to be generated in the drilling fluid at a carrier frequency that is proportional to the rate of interruption. Downhole sensor response data is transmitted to the surface of the earth by modulating the acoustic carrier frequency. A related design is that of the oscillating valve, as disclosed in U.S. Pat. No. 6,626,253, wherein the rotor oscillates relative to the stator, changing directions every 180 degrees, repeatedly interrupting the flow of the drilling fluid and causing varying pressure waves to be generated.

FIG. 1 illustrates a continuous carrier wave generating rotating siren of the second species. As can be seen in FIG. 1, when the rotor 100 and stator 102 are in streamline registry, the siren is fully open, and when the rotor 100 and stator 102 are in streamline interference, the siren is closed, generating the pressure pulse generated as a function of time. In such a configuration, the signal strength is defined by the ratio of the open area to the closed area. Erosion resistance depends on the closed area, and shock resistance depends on the clearance of the blades between the rotor 100 and the collar 104.

The design of a modulator is a trade-off between signal strength, subjectivity to jamming, erosion, and shock performance—it is desirable to increase signal strength while limiting erosion, jamming, and shock resistance.

U.S. Pat. No. 5,583,827 to Chin, entitled "Measurement While Drilling System and Method" discloses a plurality of modulator sirens in tandem to increase the data transmission rate, each of the modulators having a variable gap between the rotor and stator that enables amplitude modulation (i.e., either the rotor or the stator is axially moveable relative to the other).

U.S. Pat. Nos. 5,740,126 and 5,586,083 to Chin et al., both entitled "Turbo Siren Signal Generator for Measurement While Drilling Systems," disclose a plurality of modulator assemblies each having a different number of lobes so as to operate at different distinct frequencies, thereby providing a plurality of transmission channels. It is desirable, however, to provide improved single strength along a single transmission channel.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 2:
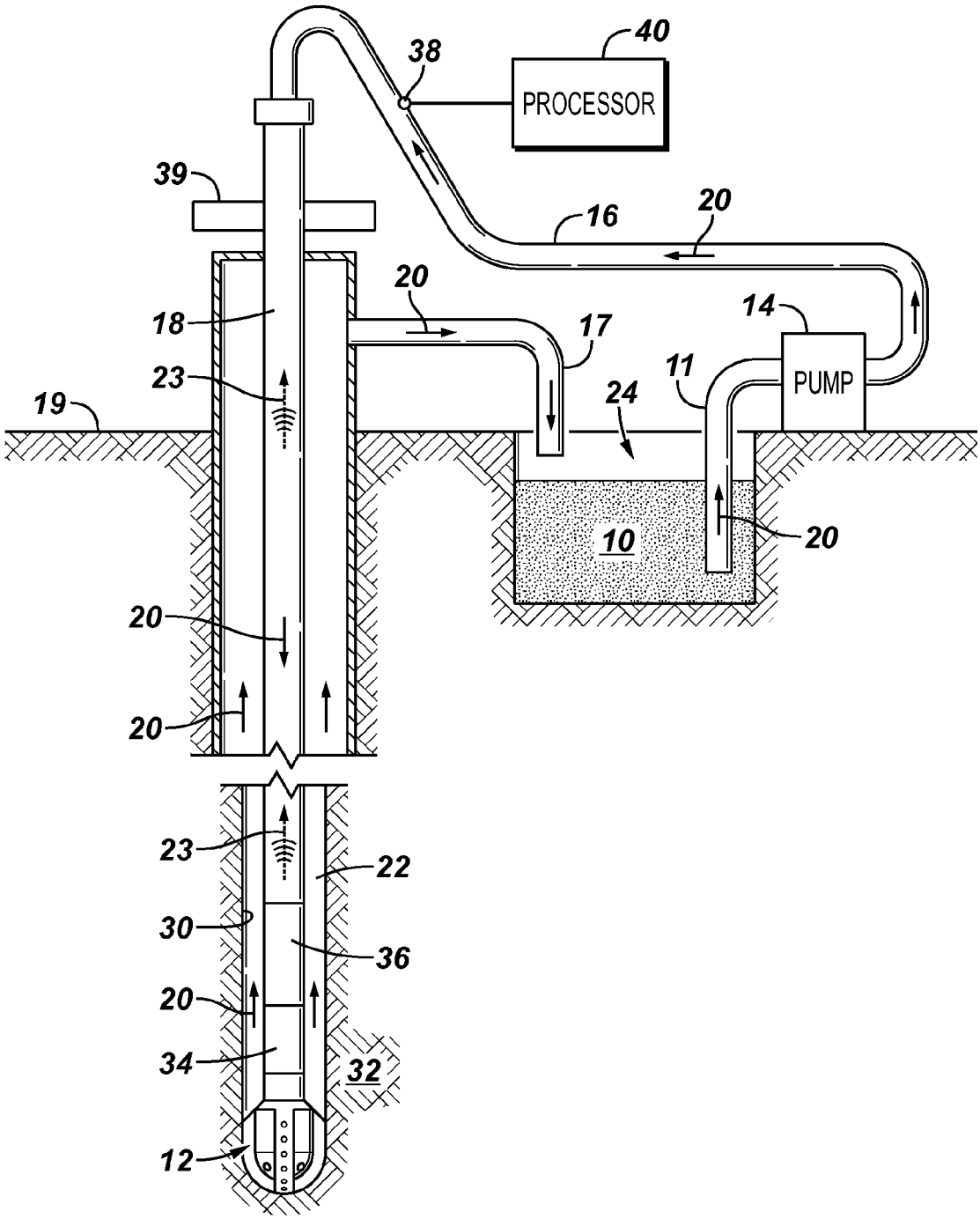
FIG. 2 depicts an illustrative drilling operation in accordance with a multi-stage modulator of the present disclosure.

FIG. 2 illustrates a drilling operation in accordance with a multi-stage modulator of the present disclosure. A drill string 18 is suspended at an upper end by a kelly 39 and conventional draw works (not shown), and terminated at a lower end by a drill bit 12. The drill string 18 and drill bit 12 are rotated by suitable motor means (not shown) thereby drilling a borehole 30 into earth formation 32. Drilling fluid or drilling "mud" 10 is drawn from a storage container or "mud pit" 24 through a line 11 by the action of one or more mud pumps 14. The drilling fluid 10 is pumped into the upper end of the hollow drill string 18 through a connecting mud line 16. Drilling fluid flows under pressure from the pump 14 downward through the drill string 18, exits the drill string 18 through openings in the drill bit 12, and returns to the surface of the earth by way of the annulus 22 formed by the wall of the borehole 30 and the outer diameter of the drill string 18. Once at the surface, the drilling fluid 10 returns to the mud pit 24 through a return flow line 17. Drill bit cuttings are typically removed from the returned drilling fluid by means of a "shale shaker" (not shown) in the return flow line 17. The flow path of the drilling fluid 10 is illustrated by arrows 20.

Still referring to FIG. 2, a MWD subsection 34 consisting of measurement sensors and associated control instrumentation is mounted preferably in a drill collar near the drill bit 12. The sensors respond to properties of the earth formation 32 penetrated by the drill bit 12, such as formation density, porosity and resistivity. In addition, the sensors can respond to drilling and borehole parameters such as borehole temperature and pressure, bit direction and the like. It should be understood that the subsection 34 provides a conduit through which the drilling fluid 10 can readily flow. A pulse generator assembly 36 is positioned preferably in close proximity to the MWD sensor subsection 34. The pulse generator assembly 36 converts the response of sensors in the subsection 34 into corresponding pressure pulses within the drilling fluid column inside the drill string 18. These pressure pulses are sensed by a pressure transducer 38 at the surface 19 of the earth. The response of the pressure transducer 38 is transformed by a processor 40 into the desired response of the one or more downhole sensors within the MWD sensor subsection 34. The direction of propagation of pressure pulses is illustrated conceptually by arrows 23. Downhole sensor responses are, therefore, telemetered to the surface of the earth for decoding, recording and interpretation by means of pressure pulses induced within the drilling fluid column inside the drill string 18.

As described previously, pulse generator assemblies are typically classified as one of two species depending upon the type of modulator device (i.e., valve) used. The first species uses a valving system, or "poppet" valve to generate a series of either positive or negative, and essentially discrete, pressure pulses which are digital representations of the transmitted data. The second species comprises a rotary valve, "mud siren," or oscillating pressure pulse generator, which repeatedly restricts the flow of the drilling fluid, and causes varying pressure waves to be generated in the drilling fluid at a frequency that is proportional to the rate of interruption. Downhole sensor response data is transmitted to the surface of the earth by modulating the acoustic carrier frequency. The pulse generator assembly 36 of the present invention may include a plurality of valve assemblies or stages of either species, as will be described in greater detail below.

Generating the pressure signal from the multi-stage modulator of the present disclosure as close to a sine wave as possible is advantageous since the energy put into generating the pressure signal is useful for actually accomplishing telemetry. There are several ways to accomplish this; one way is to design the multi-stage rotors and stators shapes such that when synchronously rotating or oscillating the rotors at a constant rotational speed, the pressure wave generated while flowing the fluid at a substantially constant flow through the modulator will generate a sine wave pressure variation. Another way is to control the the instantaneous synchronized rotors' speed by the control circuitry compensating for any deviations from sine wave pressure generation. In one embodiment, the control circuitry is a microcomputer with motor or actuator drive electronics and software instructions controlling the rotors' movement based on feed-back mechanisms described herein. The feed-back for control mechanism can be based on a model of the instantaneous variations in synchronized rotational speed needed, at a position, given the designs of the multi-stage modulator rotors' and stators' shapes. Another way is to measure actual differential pressure across the modulator and feed back this to control the rotational speed.

Figure 3A:
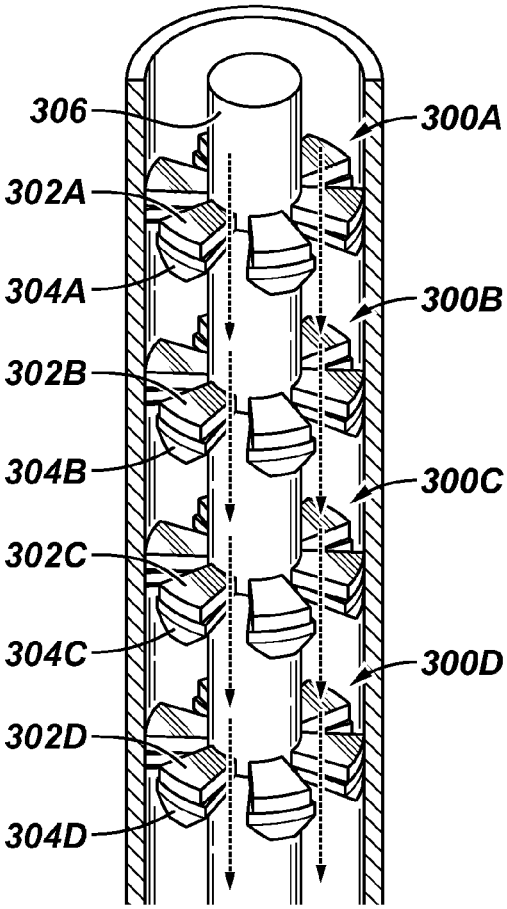
FIGS. 3A and 3B depict a multi-stage modulator, in the open position and the closed position respectively, in accordance with the present disclosure.
Figure 3B:
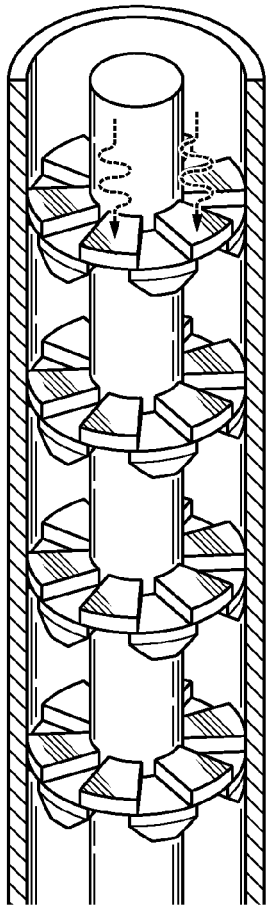

FIGS. 3A and 3B illustrate a multi-stage pulse generator assembly in accordance with the present disclosure. On the left in FIG. 3A, a multi-stage pulse generator assembly is shown in the open position. As seen in FIG. 3, a series of four stages (300A, 300B, 300C, and 300D) is provided on a single shaft 306 of the MWD tool, each stage including a fixed stator (304A, 304B, 304C, and 304D respectively) and a rotating or oscillating rotor (302A, 302B, 302C, and 302D respectively). Although FIG. 3A shows a single shaft 306 to which the series of stages 300A-D are operably coupled, it is to be understood that a plurality of rotating (or oscillating) shafts could also be employed to the same end, synchronized by independent, but synchronized motors. The stages 300A-D of FIG. 3A each include six lobes for the passage of drilling fluid therethrough, though any configuration of lobes could foreseeably be used. In some embodiments, rotors and stators of each of stages 300A-D include the same number of lobes as each other stage in the stack.

Alternatively, in other embodiments, the stages 300A-D might include rotor and stator pairs with differing number of lobes compared to the other individual stages in the series. For example, 300A and 300C might include 3 lobes in the rotors and stators, while 300B and 300D would include 6 lobes. In such a configuration, the frequency of rotation of stages 300B and 300D would be different from the frequency of rotation of stages 300A and 300C in order to maintain vertical alignment (for at least partial overlap) for the flow orifice through the series. Specifically, in the example of 300A and 300C having 3 lobes in the rotors and stators, and 300B and 300D having 6 lobes in the rotors and stators, 300A and 300C would be operated at a first frequency $f_1$, 300B and 300D would be operated at a second frequency $f_2$, and $f_2=\frac{1}{2}f_1$, since the number of rotor/stator lobes in B and D is twice the number of rotor/stator lobes in A and C. Such a configuration enables at least one method of amplitude modulation with increased signal strength. Any combination of numbers of lobes and frequencies, as long as synchronization (as described herein) is maintained, is envisioned.

On the right in FIG.3B, it is shown that the series of stages 300A-D are closed in a synchronized fashion, interrupting the flow of drilling fluid at each stage, as on the left in FIG. 3A, where it is shown that the series of stages 300A-D are opened in a synchronized fashion, permitting flow of the drilling fluid through the rotor (302A, 302B, 302C, and 302D respectively)

and stator (304A, 304B, 304C, and 304D respectively) of each stage. As used herein, the term "synchronized" used with respect to a series of stages is intended to refer to any operation of the stages such that the lobes of the rotors and stators are vertically aligned for at least a partial overlap, irrespective of direction of rotation or relative number of lobes, in the "open" or stream-line registry position. The term synchronized can also include embodiments in which each stage is configured to operate at a phase slightly offset relative to one another (i.e., still maintaining partial, but not full, overlap to form the flow orifice therethrough) to achieve amplitude modulation.

The signal strength for a single transmission channel is multiplied by the number of stages 300A-D employed in the multi-stage pulse generator assembly. For the particular embodiment shown in FIGS. 3A and 3B having four stages, the signal strength is magnified by 4 relative to the signal generated by a single stage assembly (as shown in FIGS. 1A and 1B).

Figure 1A:
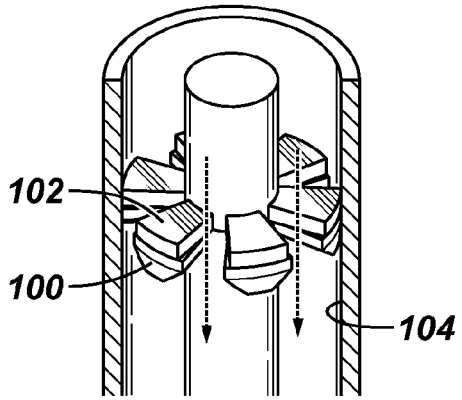
FIG. 1A (Prior Art)
FIGS. 1A and 1B depict a prior art rotating/oscillating siren for generating a continuous carrier wave.
Figure 1B:
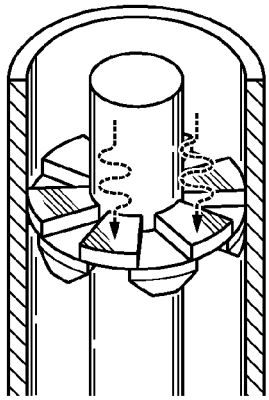
FIG. 1B (Prior Art)

In various embodiments, a series of as few as two stages could be employed together, and synchronized, resulting in a signal strength multiplied by 2, relative to a single stage modulator of the prior art, as shown in FIGS. 1A and 1B. In theory, there is no upper limit to the number of stages that could be employed in this fashion; however, practically speaking, the number of stages that can be stacked is limited by the static pressure drop of the telemetry tool, and by the complexity of the mechanical system.

In still another embodiment, amplitude modulation may also be achieved by differing the direction of rotation of at least one of the stages in the series relative to the others. Specifically, the same signal strength enhancement described above can be achieved if one or more of the stages' rotors are rotating in the opposite direction to the direction of rotation of at least one other stage's rotor, or, for example, if oscillating valves are employed, having rotors that change the direction of rotation periodically, such as every 180 degrees. As long as the synchronization is maintained, such that the at least partial overlap is maintained to produce the flow orifice described above, the signal strength enhancement is achieved.

Figure 4A:
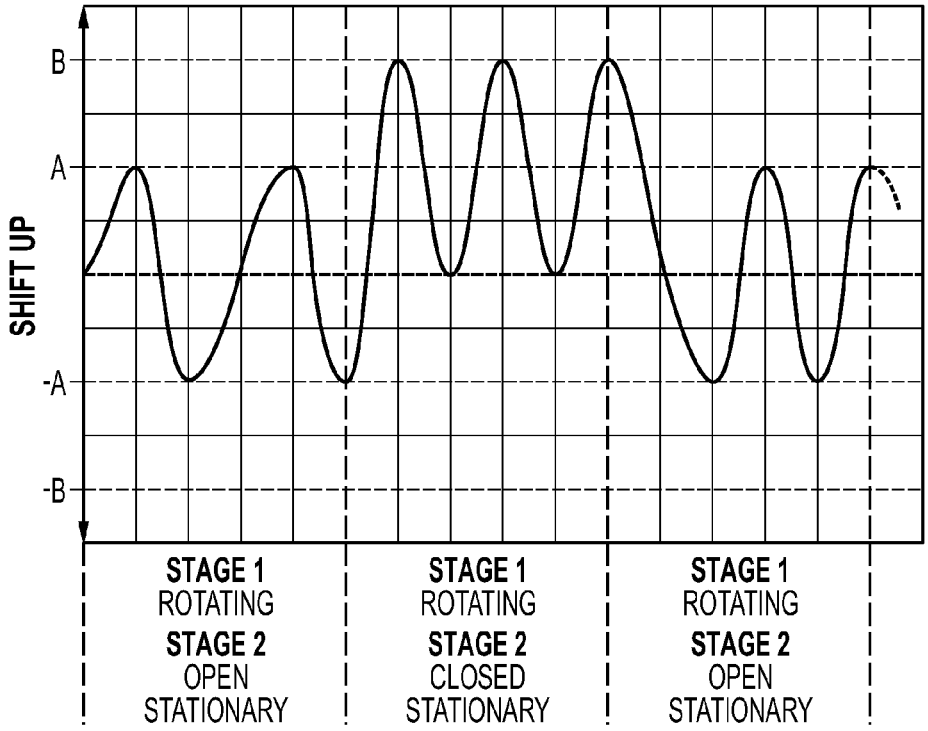
FIGS. 4A, 4B and 4C depict another embodiment of a multi-stage modulator and an accompanying pressure pulse signal depicting a form of amplitude modulation enabled with the modulator shown, in accordance with the present disclosure.

In still another embodiment, amplitude modulation may be achieved in still another manner as is explained with reference to FIG. 4A. FIG. 4A first shows a sinusoidally varying signal having an Amplitude from A to −A in a first and third period, and a shifted position having an Amplitude from 0 to B in a second period. In one embodiment, the Stage 1 assembly has a rotating rotor and operates at frequency $f_1$. For the first and third period, the Stage 2 assembly is kept from rotating, instead holding an open position, maximizing flow therethrough. For the second period, the Stage 2 assembly is held at a different position, closed (albeit permitting flow with high resistance therethrough) however, the wave of the produced signal is shifted up accordingly for the period that Stage 2 remains in the closed position, representing at least one symbol. Upon moving the Stage 2 assembly back to the open position and holding the rotor stationary, the position of the produced signal shifts back, changing the symbol represented.

It is envisioned that any combination of frequency, phase, or amplitude modulation may be enabled by incorporation of the multi-stage modulator of the present disclosure.

Figure 4B:
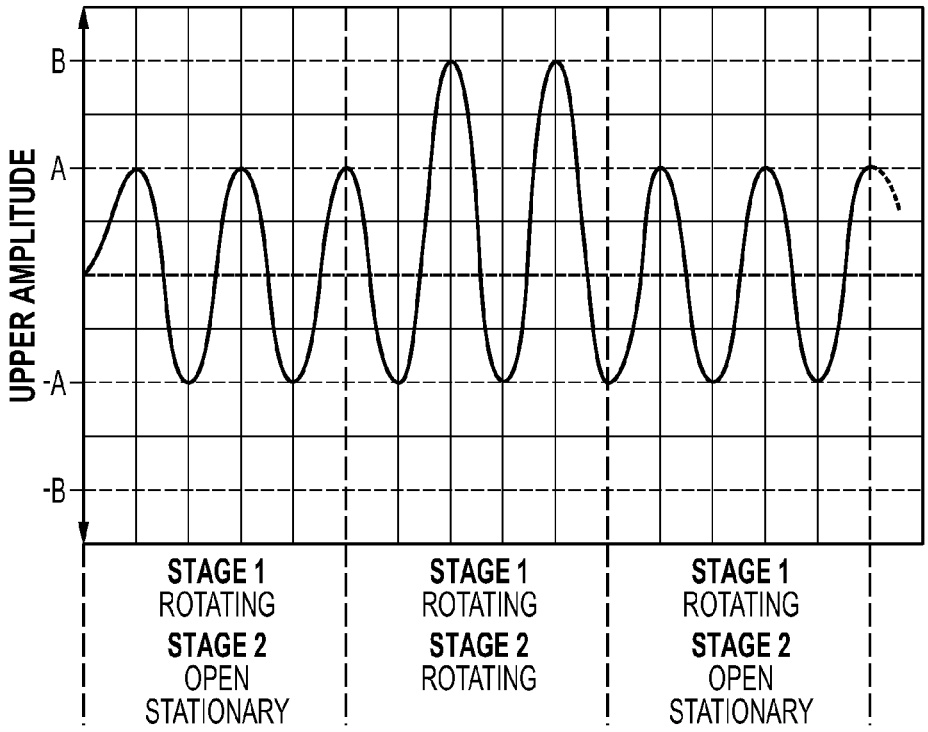

Alternatively, in FIG. 4B the multi-stage modulator produces a sinusoidally varying signal having an Amplitude from A to −A in a first and third period, and a shifted position having an Amplitude from −A to B in a second period. In one embodiment, the Stage 1 assembly has a rotating rotor and operates at frequency $f_1$. For the first and third period, the Stage 2 assembly is kept from rotating, instead holding an open position, maximizing flow therethrough. For the second period, the Stage 2 assembly is synchronously rotated, resulting in the upper limit of the amplitude shifting up accordingly for the period that Stage 2 rotates, representing at least one symbol. Upon moving the Stage 2 assembly back to the open position and holding the rotor stationary, the upper limit of the amplitude of the produced signal shifts back, changing the symbol represented.

Figure 4C:
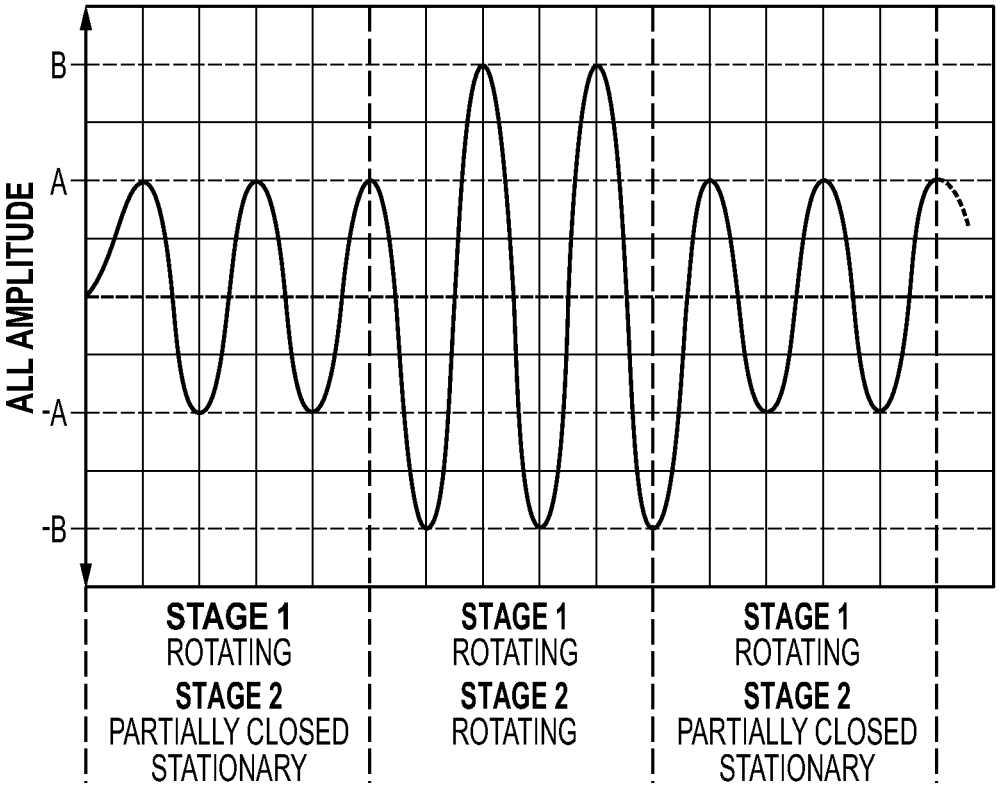

In FIG. 4C, the multi-stage modulator produces a sinusoidally varying signal having an Amplitude from A to −A in a first and third period, and a shifted position having an Amplitude from −B to B in a second period. In one embodiment, the Stage 1 assembly has a rotating rotor and operates at frequency $f_1$. For the first and third period, the Stage 2 assembly is kept from rotating, instead holding a partially closed position, permitting, but controlling, flow therethrough. For the second period, the Stage 2 assembly is synchronously rotated, resulting in the increase in the amplitude accordingly for the period that Stage 2 rotates, representing at least one symbol. Upon moving the Stage 2 assembly back to the partially open position and holding the rotor stationary, the upper limit of the amplitude of the produced signal shifts back, changing the symbol represented.

The various sine waves shown in FIGS. 4A-C illustrate that differing types of modulation can be accomplished by changing the stationary position of one or more of the stages of the modulator or rotational frequency of one or more of the stages, and any combination thereof. Indeed, even a combination of any of the following: amplitude, phase, and frequency modulation may be accomplished with the multi-stage modulator of the present disclosure.

As to the relative placement of the stages along the shaft(s), the distance between each successive stage should be significantly less than the wavelength of the frequency of the generated wave. For example, in a preferred embodiment, the distance between stages would be significantly less than 160 feet, which is approximately the wavelength at 24 Hz. The stages also would be placed at least far enough from one another so as to minimize the effect of turbulence in the drilling fluid. In various embodiments, this minimum separation would be at least three (3) inches apart depending on the geometry of the flow section. In at least some embodiments, to further minimize turbulence between stages, one or more fins can be added to the rotors of each respective stage as would be well known by one of ordinary skill in the art.

Since the signal strength can be dramatically increased with the multi-stage modulator, anti-jamming, erosion, and shock can be improved upon at the cost of some of the added signal strength. Improved anti-jamming and improved erosion can be achieved by increasing the tip clearance between the rotor edge and the surrounding rum, or increasing the gap between the rotor and stator. Additionally, though somewhat less desirable, the ratio of the open area to the closed area defining the flow orifice through the modulator can be increased. Such means of improving anti-jamming, and resistance to erosion and shock have previously been recognized, but not typically adopted in design due to the cost in signal strength, however, with the increased signal strength provided by the multi-stage modulator, such means can be implemented while still enjoying increased signal strength over single stage modulator designs.

Specifically, the multi-stage modulator of the present disclosure enables improved anti-jamming. When the signal strength level is adequate, by stacking a plurality of stages, the configuration offers a high level of resistance to jamming. Specifically, this can be achieved by increasing the tip clearance between the rotor edge and the rim surrounding the rotor (which is typically 0.03 inch to 0.1 inch).as well as the gap between the rotor and the stator (which is typically 0.1 inch). In preferred embodiments, the gap between the rotor and stator is a fixed distance once the assembly has been assembled and/or placed in the wellbore.

Additionally, opening the closed area of a stage to reduce the effects of erosion and shock in a dual (or multiple) stage modulator significantly improves the erosion and shock performance while achieving increases in signal strength. When erosion is a lesser issue, the multi-stage modulator increases the signal by 6 dB, corresponding to a quadrupled data rate in certain conditions.

The same technique of staging multiple valves in series can be applied to poppet valve style modulators to create positive or negative pulse telemetry systems, if the valves do not close entirely, but permit at least a minimal flow through in the "closed" position.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A pressure pulse generator assembly, comprising:

a plurality of stages, each stage comprising:

a rotor having one or more rotor lobes; and a fixed stator having one or more stator lobes, said fixed stator being separated from the rotor by a fixed distance; and one or more motors driving the plurality of stages in a substantially synchronized manner, wherein the motors are adapted to produce pulses in a flowing fluid, and wherein each of the plurality of stages are spaced apart from one another at a distance less than a wavelength of the pulses in the flowing fluid.

2. The pressure pulse generator assembly according to claim 1, further comprising a driving mechanism for controlling movement of the rotors to synchronize the stages.

3. The pressure pulse generator assembly according to claim 1, wherein each stage includes a common number of the rotor lobes and stator lobes.

4. The pressure pulse generator assembly according to claim 1, wherein at least one stage of the plurality of stages has a different number of rotor lobes and stator lobes from the number of rotor lobes and stator lobes of the remainder of the plurality of stages, and wherein the one or more motors drives the stage with the different number of rotor lobes and stator lobes at a different frequency than the remainder of the plurality of stages so as to maintain synchronization.

5. The pressure pulse generator assembly according to claim 1, wherein the plurality of stages are aligned along a single shaft.

6. The pressure pulse generator assembly according to claim 1, wherein the plurality of stages are aligned along two or more shafts coupled together and driven synchronously by the one or more motors.

7. The pressure pulse generator assembly according to claim 1, wherein each stage is driven in the same direction.

8. The pressure pulse generator assembly according to claim 1, wherein at least one stage of the plurality of stages is driven in an opposite direction relative to the rotational direction of the other stages.

9. The pressure pulse generator assembly according to claim 1, wherein each of the stages of the pressure pulse generator assembly is spaced apart from the next closest stage at a distance greater than or equal to a distance of approximately 3-5 inches to minimize turbulence effects.

10. The pressure pulse generator assembly according to the claim 1 wherein the synchronized movement of rotors of the plurality of stages is controlled such that a pressure wave generated is one of substantially sine and cosine wave.

11. A pressure pulse generator assembly, comprising:

a plurality of stages, each stage comprising:

a rotor having one or more rotor lobes; and a fixed stator having one or more stator lobes, said fixed stator being separated from the rotor by a fixed distance; and one or more motors driving the plurality of stages in a substantially synchronized manner, wherein the motors are adapted to produce pulses in a flowing fluid, and wherein each of the stages of the pressure pulse generator assembly is spaced apart from the next closest stage at a distance less than $1/20^{th}$ of a wavelength of the pulses in the flowing fluid.

12. A method for generating pressure pulses within a flowing fluid, comprising:

providing a pressure pulse generator assembly comprising a plurality of stages, each stage comprising a rotor and a fixed stator separated by a fixed distance;

driving the rotors of said stages in a substantially synchronized fashion with respect to the stators of said stages with at least one motor to produce pulses in the flowing fluid; and positioning the plurality of stages apart from one another at a distance less than a wavelength of the pulses in the flowing fluid.

13. The method according to claim 12, wherein driving the rotors of said stages in a substantially synchronized fashion with respect to the stators of said stages further comprises one of rotating the rotors relative to the stators and oscillating the rotors relative to the stators.

14. The method according to claim 12, further comprising providing the plurality of stages on a single shaft of the pressure pulse generator assembly.

15. The method according to claim 12, further comprising providing the plurality of stages on a plurality of operably coupled, substantially synchronized shafts of the pressure pulse generator assembly.

16. The method according to claim 12, further comprising positioning the plurality of stages apart from one another at a distance greater than or equal to a distance of approximately 3-5 inches to minimize turbulence effects.

17. The method according to claim 12, wherein the rotors and the stators of each the plurality of stages comprise a common number of lobes.

18. The method according to claim 12, further comprising:

providing at least one stage of the plurality of stages having a different number of rotor lobes and stator lobes from the number of rotor lobes and stator lobes of the remainder of the plurality of stages; and driving the stage with the different number of rotor lobes and stator lobes at a different frequency than the remainder of the plurality of stages so as to maintain synchronization and modulation of the pressure of the flow.

19. The method according to claim 12, wherein driving the rotors of said stages in a substantially synchronized fashion with respect to the stators of said stages further comprises driving at least one of the plurality of stages in a clockwise direction and another of the plurality of stages in a counter-clockwise direction.

20. A method for generating pressure pulses within a flowing fluid, comprising:

providing a pressure pulse generator assembly comprising a plurality of stages, each stage comprising a rotor and a fixed stator separated by a fixed distance;

driving the rotors of said stages in a substantially synchronized fashion with respect to the stators of said stages with at least one motor to produce pulses in the flowing fluid; and positioning the plurality of stages apart from one another at a distance less than $1/20^{th}$ of wavelength of the pulses in the flowing fluid.

21. A method for generating pressure pulses within a flowing fluid, comprising:

providing a plurality of staged valves serially in a bottomhole assembly of a wellbore tool;

opening the plurality of staged valves in a synchronized manner such that each of the plurality of staged valves are open at the same time and closed at the same time, thereby generating a series of pressure pulses in the flowing fluid, wherein at least one motor drives the plurality of staged valves; and positioning the plurality of staged valves apart from one another at a distance less than a wavelength of the pulses in the flowing fluid.

22. The method according to claim 21, wherein at least one of the plurality of staged valves comprise poppet valves.

23. The method according to claim 21, wherein the plurality of staged valves comprise rotating siren valves, each staged valve comprising a rotor with one or more rotor lobes and a stator with one or more stator lobes.

24. The method according to claim 21, wherein the plurality of staged valves comprise oscillating valves, each staged valve comprising a rotor with one or more rotor lobes and a stator with one or more stator lobes.

25. A method for generating pressure pulses within a flowing fluid, comprising:

providing a first stage valve in a bottomhole assembly of a wellbore tool;

providing a second stage valve in series with the first stage valve;

operating the first stage valve at a first frequency;

positioning the first stage valve apart from the second stage valve at a distance less than a wavelength of the pulses in the flowing fluid; and changing the second stage valve from a held first position to a held second position, thereby achieving amplitude modulation of pressure of the fluid flowing therethrough; wherein at least one motor drives the first stage valve.

26. The method according to claim 25, further comprising changing the frequency of the first stage valve to a second frequency.

27. A method for generating pressure pulses within a flowing fluid, comprising:

providing a first stage valve in a bottomhole assembly of a wellbore tool;

providing a second stage valve in series with the first stage valve, wherein the first stage valve is spaced apart from the second stage valve at a distance less than a wavelength of the pulses in the flowing fluid;

operating the first stage valve at a first frequency; and changing the second stage valve from a held first position to rotate synchronously with the first stage, thereby achieving amplitude modulation of pressure of the fluid flowing therethrough; wherein at least one motor drives the first and second stage valves.

* * * * *